US009966051B2

(12) United States Patent
Takehisa

(10) Patent No.: US 9,966,051 B2
(45) Date of Patent: May 8, 2018

(54) SOUND PRODUCTION CONTROL APPARATUS, SOUND PRODUCTION CONTROL METHOD, AND STORAGE MEDIUM

(71) Applicant: YAMAHA CORPORATION, Hamamatsu-shi (JP)

(72) Inventor: Hideaki Takehisa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days. days.

(21) Appl. No.: 15/448,942

(22) Filed: Mar. 3, 2017

(65) Prior Publication Data

US 2017/0263230 A1 Sep. 14, 2017

(30) Foreign Application Priority Data

Mar. 11, 2016 (JP) ..... 2016-048197
Jan. 17, 2017 (JP) ..... 2017-005823

(51) Int. Cl.

| | |
|---|---|
| ***G10H 3/00*** | (2006.01) |
| ***G10H 1/053*** | (2006.01) |
| ***G10H 1/00*** | (2006.01) |
| ***G10H 3/14*** | (2006.01) |

(52) U.S. Cl.
CPC ..... *G10H 1/053* (2013.01); *G10H 1/0008* (2013.01); *G10H 3/146* (2013.01); *G10H 2210/281* (2013.01); *G10H 2210/391* (2013.01); *G10H 2220/201* (2013.01)

(58) Field of Classification Search
CPC ..... G10H 1/0091; G10H 2220/201; G10H 2220/455; G10H 2220/321; G10H 2220/391; G10H 2210/375
See application file for complete search history.

(56) References Cited

U.S. PATENT DOCUMENTS 5,166,466 A * 11/1992 Yamauchi ..... G10H 1/055 338/69
2002/0166437 A1* 11/2002 Nishitani ..... G10D 3/00 84/453
2002/0166438 A1* 11/2002 Nishitani ..... G10H 1/0008 84/600

(Continued)

FOREIGN PATENT DOCUMENTS

JP H06110454 A 4/1994

OTHER PUBLICATIONS

"Abstract of Human Pose Estimation Technology" Microsoft. http://news.mynavi.jp/series/computer_vision/069/. 2 pages. Partial English translation provided.

*Primary Examiner* — Marlon Fletcher
(74) *Attorney, Agent, or Firm* — Rossi, Kimms & McDowell LLP

(57) ABSTRACT

A sound production control apparatus by which a sound production mode is controlled on the basis of a player's motion even during a non-playing control operation period. An information obtaining unit 30 obtains detection information by detecting a player's motion. A sound processing unit 36 produces sound on the basis of the detection information obtained in response to operation for generating a sound trigger in the player's motion, and controls a sound production mode on the basis of the detection information obtained in response to operation for generating no sound trigger in the player's motion.

13 Claims, 10 Drawing Sheets

(56) References Cited

U.S. PATENT DOCUMENTS

2003/0041721 A1* 3/2003 Nishitani ..... G10H 1/00 84/609
2005/0016362 A1* 1/2005 Nishitani ..... G10H 1/0008 84/612
2005/0126370 A1* 6/2005 Takai ..... A63B 24/0003 84/636
2011/0290097 A1* 12/2011 Takahashi ..... G10H 1/34 84/622
2011/0303076 A1* 12/2011 Harada ..... G10H 1/14 84/742
2012/0024128 A1* 2/2012 Takahashi ..... G10H 1/0008 84/600
2012/0103168 A1* 5/2012 Yamanouchi ..... G10H 1/0008 84/723
2012/0137858 A1* 6/2012 Sakazaki ..... G10H 1/053 84/723
2012/0216667 A1* 8/2012 Sakazaki ..... G10H 3/14 84/725
2013/0047823 A1* 2/2013 Tabata ..... G10H 1/0008 84/639
2013/0118339 A1* 5/2013 Lee ..... G10H 1/32 84/725
2013/0228062 A1* 9/2013 Tabata ..... G10H 1/0008 84/602
2013/0239780 A1* 9/2013 Tabata ..... G10H 1/0008 84/602
2013/0239781 A1* 9/2013 Yoshihama ..... G10H 7/00 84/609
2013/0239782 A1* 9/2013 Yoshihama ..... G10H 7/00 84/609
2013/0239784 A1* 9/2013 Tabata ..... G10H 1/0008 84/609
2013/0239785 A1* 9/2013 Tabata ..... G10H 1/0008 84/609
2013/0255476 A1* 10/2013 Sakurai ..... G10H 5/00 84/723
2014/0316305 A1* 10/2014 Venkatraman ..... A61B 5/1112 600/595
2016/0084869 A1* 3/2016 Yuen ..... G01P 7/00 73/510

* cited by examiner

SOUND PRODUCTION CONTROL APPARATUS, SOUND PRODUCTION CONTROL METHOD, AND STORAGE MEDIUM

BACKGROUND OF THE INVENTION

Field of the Invention

The present invention relates to a sound production control apparatus, a sound production control method, and a storage medium, by which sound produced from operation of a player is controlled on the basis of player's operation.

Conventionally, a sound production control in which an effect such as a delay is added to sound produced from playing operation of a player. If the time between events of played music changes according to progression of chords or a playing tempo although a delay time set to provide the delay is a fixed value, the added effect may become unnatural in some cases. To cope with this, JP 6-110454 A discusses a technique of controlling additional effect characteristics on the basis of play speed information in instrumental playing.

However, in general, a player tends to make some motions to keep the tempo or for other purposes even during a non-playing control operation period such as a non-playing operation period for which a player does not make playing operation in the middle of an instrumental or a non-control operation period for which a player does not make operation for controlling a hi-hat to be closed or opened. For example, a player may make a motion for operating an operating element without producing sound. Herein, such a motion will be referred to as a "ghost motion". For example, a player controls the hi-hat cymbals to be closed or opened by depressing a pedal during a performance. However, during a non-control operation period, a player keeps beats by lifting and lowering a player's heel while a player's toe is placed on the pedal (during the lifting and lowering, the heel may be placed on the pedal occasionally) as a ghost motion.

However, the ghost motion itself is performed to keep the tempo for a player as described above. Therefore, the player's operation is not reflected on sound production, and the effect also does not change thereby. For example, assuming that a player makes a ghost motion on the hi-hat pedal described above, the ghost motion does not provide a play sound and is not reflected on the effect of the sound produced by striking other pads. For example, in the technique discussed in JP 6-110454 A, if a play speed of the instrumental is changed, this change is reflected on the effect. However, the ghost motion is not reflected on the effect.

The ghost motion is a player's motion usually made during a non-playing period for a player to retain the accurate playing tempo or express accents or presence of the playing. If a ghost motion caused by the tempo or the "groove" of music is used in a sound production control, more excellent sound quality can be obtained.

SUMMARY OF THE INVENTION

The present invention provides a sound production control apparatus, a sound production control method, and a storage medium, by which a sound production mode is controlled on the basis of a player's motion even during a non-playing control operation period. In addition, the present invention provides a sound production control apparatus, a sound production control method, and a storage medium, by which a playing tempo is estimated from a player's motion even during a non-playing control operation period.

Accordingly, a first aspect of the present invention provides a sound production control apparatus comprising an information obtaining unit that obtains detection information by detecting a player's motion, a sound production unit that produces sound on the basis of the detection information obtained in response to operation for generating a sound trigger in the player's motion by the information obtaining unit, and a control unit that controls a sound production mode of the sound production unit on the basis of the detection information obtained in response to operation for generating no sound trigger in the player's motion by the information obtaining unit.

Accordingly, a second aspect of the present invention provides a sound production control apparatus comprising an information obtaining unit that obtains detection information by detecting a player's motion, a sound production unit that produces sound on the basis of the detection information obtained in response to operation for generating a sound trigger in the player's motion by the information obtaining unit, and an estimation unit that estimates a playing tempo performed by the player on the basis of the detection information obtained in response to operation for generating no sound trigger in the player's motion by the information obtaining unit.

Accordingly, a first aspect of the present invention provides a sound production control method comprising an information obtaining step for obtaining detection information by detecting a player's motion, a sound production step for producing sound on the basis of the detection information obtained in response to operation for generating a sound trigger in the player's motion in the information obtaining step, and a control step for controlling a sound production mode in the sound production step on the basis of the detection information obtained in response to operation for generating no sound trigger in the player's motion in the information obtaining step.

Accordingly, a second aspect of the present invention provides sound production control method comprising an information obtaining step for obtaining detection information by detecting a player's motion, a sound production step for producing sound on the basis of the detection information obtained in response to operation for generating a sound trigger in the player's motion in the information obtaining step, and an estimation step for estimating a playing tempo performed by the player on the basis of the detection information obtained in response to operation for generating no sound trigger in the player's motion in the information obtaining step.

According to the first aspect of the present invention, it is possible to control the sound production mode on the basis of a player's motion even during a non-playing control operation period.

According to the first aspect of the present invention, it is possible to reflect a motion that has no intention to operate the operating element on the sound production control.

According to the first aspect of the present invention, it is possible to control sound production caused by a playing motion on the operating element on the basis of a player's motion on the operating element, the latter motion having no intention to operate the operating element.

According to the first aspect of the present invention, it is possible to reflect a movement of a player's body on the sound production control.

According to the first aspect of the present invention, it is possible to reflect a beat-keeping motion on the sound production control, the beat-keeping motion having no intention to play an instrument.

According to the first aspect of the present invention, it is possible to reflect a player's motion on the effect, the player's motion having no intention to play an instrument.

According to the first aspect of the present invention, it is possible to estimate a tempo from the player's motion, the player's motion having no intention to play an instrument.

According to the second aspect of the present invention, it is possible to estimate a playing tempo from a player's motion even during the non-playing control operation period and reflect the estimated playing tempo on the sound production control.

Further features of the present invention will become apparent from the following description of exemplary embodiments (with reference to the attached drawings).

DESCRIPTION OF THE EMBODIMENTS

Embodiments of the present invention will now be described with reference to the accompanying drawings.

Figure 1:
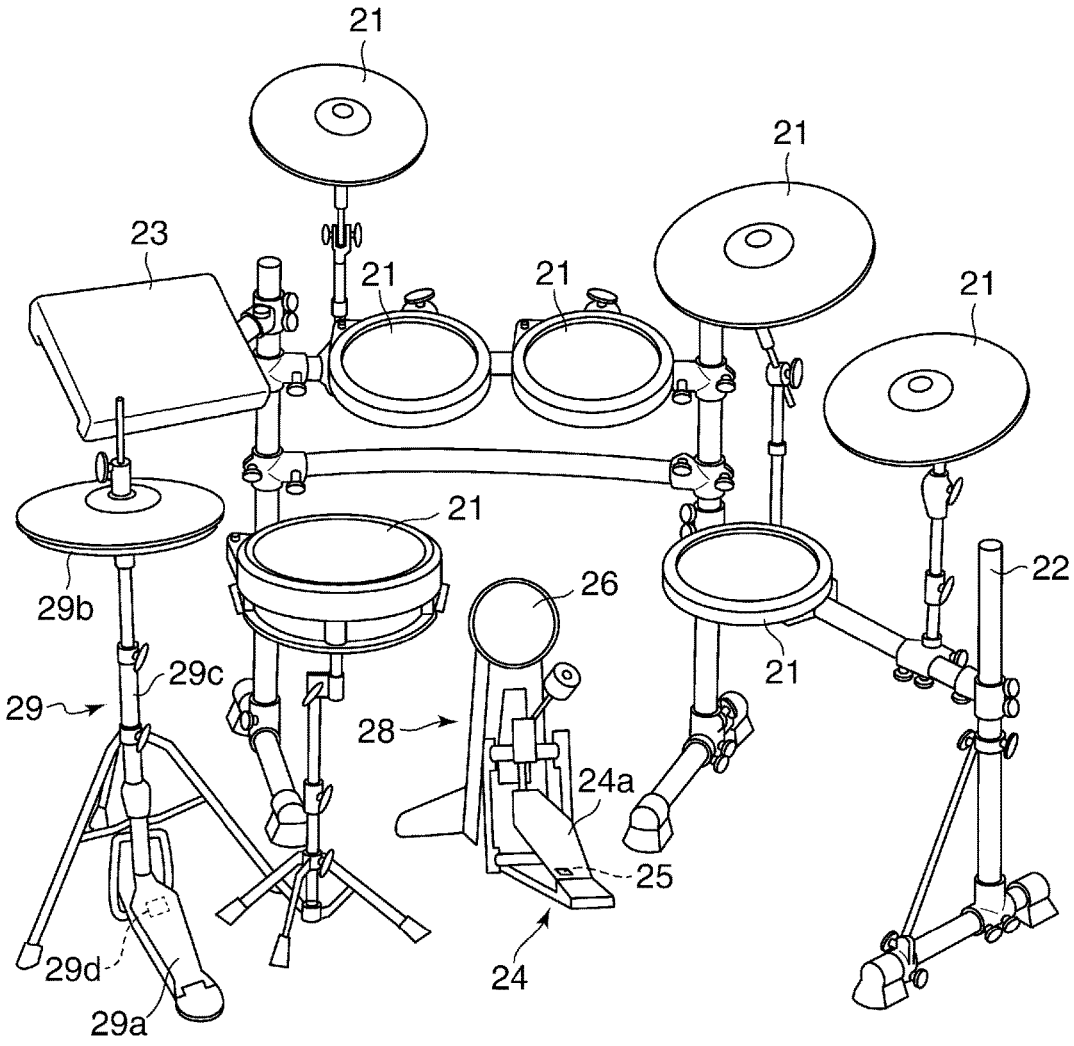
FIG. 1 is a perspective view illustrating an instrument according to an embodiment of the invention.

FIG. 1 is a perspective view illustrating an instrument according to an embodiment of the invention. This instrument is an electronic percussion instrument 20 having a stand 22, a kick unit (bass drum unit) 28 provided on a floor, and a hi-hat unit 29. A plurality of pads 21 are detachably installed in the stand 22, and a controller 23 is also installed. The respective pads 21 have different shapes, but, in this embodiment, all of the pads 21 will be referred to as a "pad 21". Each pad 21 is provided with a percussion sensor (not shown). The percussion sensor detects percussion through a vibration of the pad 21, and its detection signal is supplied to the controller 23. In addition, the kick unit 28 has a pad 26 and a kick pedal 24. The kick pedal 24 is placed on a floor and has a pedal unit 24*a* operated by a pushing motion of a player's toe. The kick pedal 24 is provided with a pedal sensor 25 for continuously detecting operation of the pedal unit 24*a*, and a detection value corresponding to an operational stroke of the pedal unit 24*a* is output from the pedal sensor 25 as a continuous amount. In addition, the hi-hat unit 29 has a hi-hat pedal portion 29*a*, a hi-hat pad 29*b*, and a hi-hat stand 29*c* that connects the hi-hat pedal portion 29*a* and the hi-hat pad 29*b* and is placed on the floor. The hi-hat pedal portion 29*a* is provided with a pedal sensor 29*d* for continuously detecting operation of the hi-hat pedal portion 29*a*, and a detection value corresponding to an operational stroke (movement) of the hi-hat pedal portion 29*a* is output from the pedal sensor 29*d* as a continuous amount. It should be noted that the pedal sensor 29*d* is not limited to those capable of detecting a continuous amount, but any other type may be employed. For example, a pedal sensor that detects the operational amount in a multiple stage manner using a multistage switch and the like may also be employed.

Figure 2:
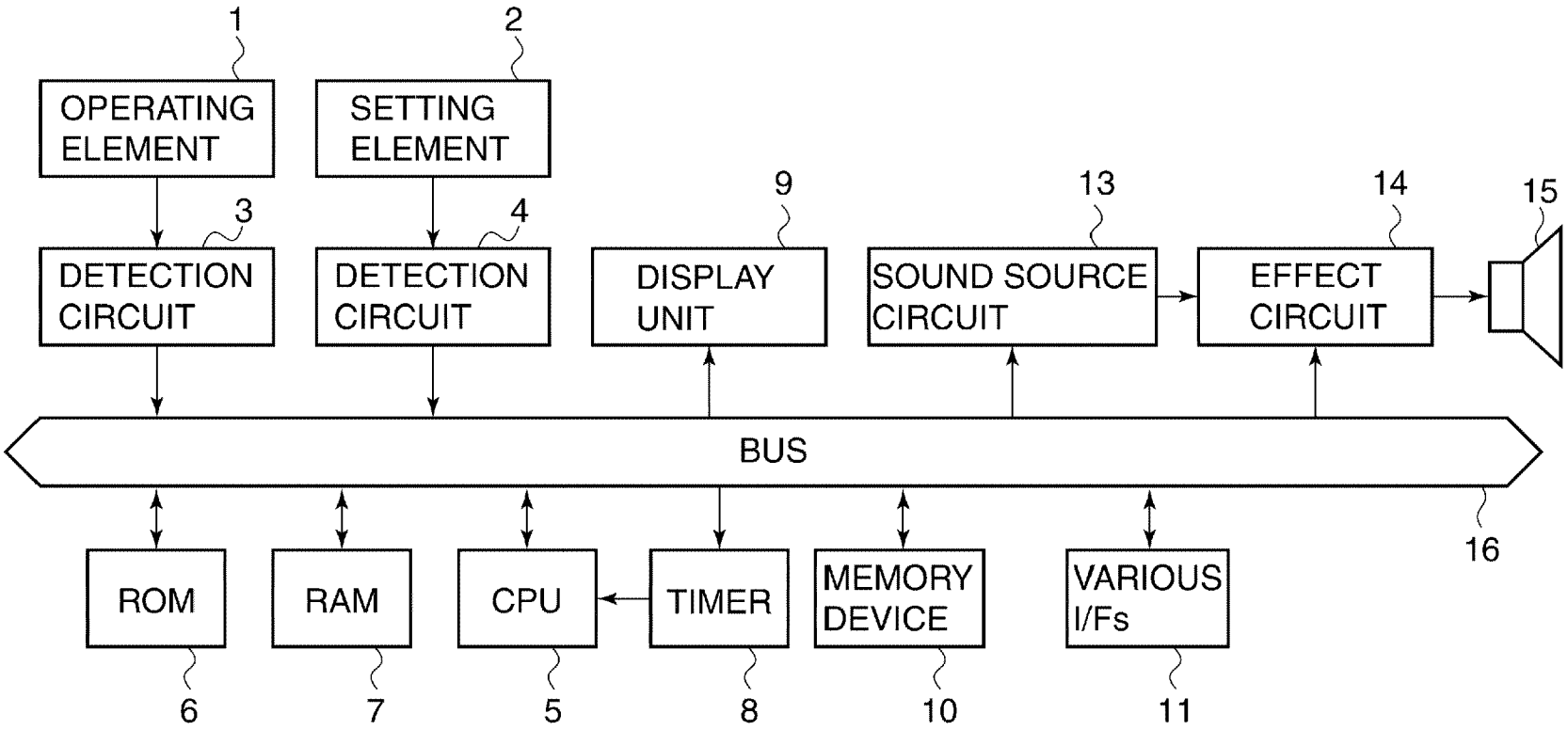
FIG. 2 is a block diagram illustrating an entire configuration of an electronic percussion instrument.

FIG. 2 is a block diagram illustrating an entire configuration of the electronic percussion instrument 20. Detection circuits 3 and 4, a read-only memory (ROM) 6, a random access memory (RAM) 7, a timer 8, a display unit 9, a memory device 10, various interfaces (I/Fs) 11, a sound source circuit 13, and an effect circuit 14 are connected to a central processing unit (CPU) 5 through a bus 16. An operating element 1 includes the pads 21 and 26. The detection circuit 3 detects an operational state of the operating element 1 on the basis of the output of the percussion sensor or the pedal sensor 25, and the detection circuit 4 detects an operational state of a setting manipulator 2. The controller 23 is a sound production control apparatus according to the present invention and includes the CPU 5, each element connected to the CPU 5 (excluding the operating element), and the setting manipulator 2.

The display unit 9 is comprised of a liquid crystal display (LCD) or the like to display various types of information. The timer 8 is connected to the CPU 5. A sound system 15 is connected to the sound source circuit 13 through the effect circuit 14. Various I/Fs 11 include a musical instrument digital interface (MIDI) I/F and a communication I/F. The CPU 5 controls the entire instrument. The ROM 6 stores a control program executed by the CPU 5, various table data, and the like. The RAM 7 temporarily stores various types of input information, various flags or buffer data, computation results, and the like. The memory device 10 is comprised of, for example, a nonvolatile memory and stores the aforementioned control program, various musical data, various other data, and the like. The sound source circuit 13 converts playing data input from the operating element 1, preset playing data, and the like into music signals. The effect circuit 14 applies various effects to the music signals input from the sound source circuit 13, and the sound system 15 including a digital-to-analog converter (DAC), an amplifier, a loudspeaker, and the like converts the music signals input from the effect circuit 14 into acoustic sounds. The CPU 5 controls the sound source circuit 13 and the effect circuit 14 on the basis of the detection result of the detection circuit 3 to generate produce sound from the sound system 15. It should be noted that an example of the setting for the effect of sound produced by a percussion of each of pads 21 and 26 will be described below with reference to FIGS. 6 to 8.

According to this embodiment, a motion that is not intended to make playing (sound production) in a player's motion is detected, and the sound triggered by a player's motion for playing (sound production) is controlled on the basis of the detection result. The sound production control may include a control of the added effect. Using at least information not corresponding to a sound trigger in a player's motion, effect control parameters are determined, and the effect is controlled on the basis of the determined effect control parameters. In many cases, a player makes a certain motion in a mode in which the sound trigger is not generated for the purpose of tempo keeping even in a non-playing operation period in which the player is not required to play in the middle of an instrumental. In this manner, a motion that is not intended to produce sound is called a "ghost motion (hereinafter, abbreviated as a "G-motion"). For example, according to this embodiment, when a G-motion is operated using the hi-hat pedal portion 29*a*, this operation is detected, and a delay time for delay sound as the effect control parameter is set in response to the detection of that operation.

Figure 3A:
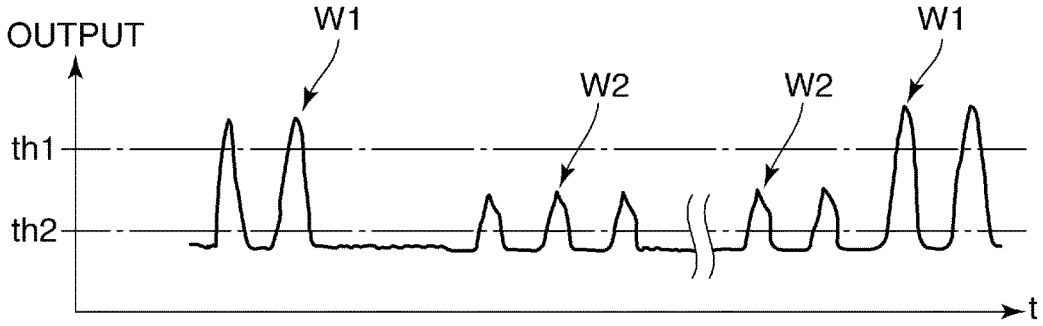
FIG. 3A is a diagram illustrating an output waveform of a output waveform.

FIG. 3A is a diagram illustrating an output waveform of the pedal sensor 29*d*, in which the abscissa denotes time t, and the ordinate denotes a sensor output. In FIG. 3A, there are shown waveforms W1 having a high peak and waveforms W2 having a peak sufficiently lower than that of the waveforms W1. A player deeply depresses the pedal unit 24*a* in order to control a sound production mode of an open/close state of the hi-hat unit 29 or produce a foot-close sound. It should be noted that, in the following description, for simplicity purposes, the foot-close sound production motion will be treated as playing operation. A waveform generated due to this foot-close playing operation (operation for generating a sound trigger) on the pedal sensor 29*d* is the waveform W1. Meanwhile, during the non-playing control operation period, a player places his/her toe on the hi-hat pedal portion 29*a* as a G-motion and keeps the beats by lifting or lowering his/her heel. A waveform generated from the pedal sensor 29*d* subjected to this G-motion is the waveform W2. Both an interval between the peaks of the waveforms W1 and an interval between the peaks of the waveforms W2 typically match a beat interval of an instrumental.

Figure 3B:
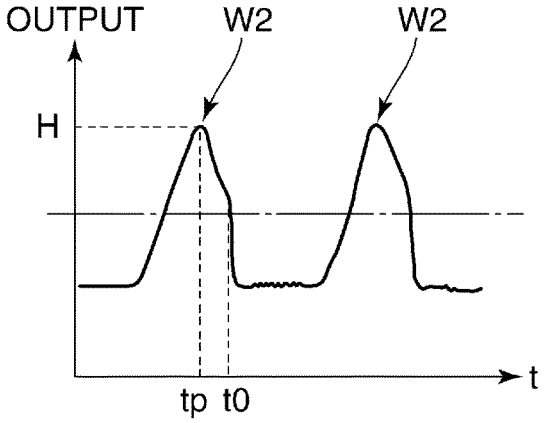
FIG. 3B is an enlarged view illustrating the waveform appearing in FIG. 3A.

FIG. 3B is an enlarged view illustrating the waveforms W2. A peak timing of the waveform W1 typically matches a beat timing, whereas a peak timing of the waveform W2 is slightly deviated from the beat timing. This is because the pedal unit 24*a* is slightly depressed by a player's toe which is forced when a player's heel is lifted immediately before the heel lifting and lowering motion at the beat timing so as to prepare for this heel lifting and lowering motion. In FIG. 3B, the time point tp denotes the peak timing of the waveform W2. The time point t0 denotes the timing that a player's heel reaches its lowest position in the heel lifting and lowering motion. According to this embodiment, during a play period, the CPU 5 determines the beat interval and the playing tempo parameters mainly on the basis of the peak timings of the waveforms W1. Meanwhile, during the non-playing control operation period, the CPU 5 determines the beat interval and the playing tempo parameters on the basis of the timing of the time point t0 of the waveform W2.

Figure 3C:
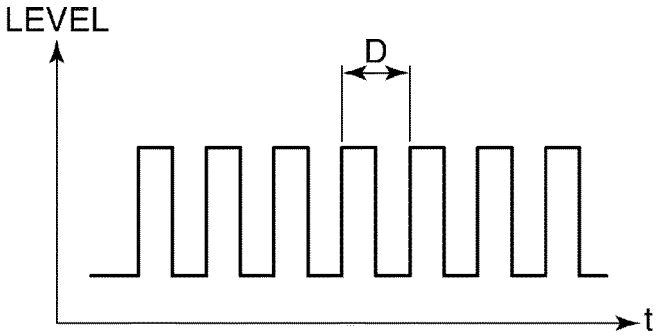
FIG. 3C is a diagram illustrating a pulse waveform generated from the waveform.
Figure 4:
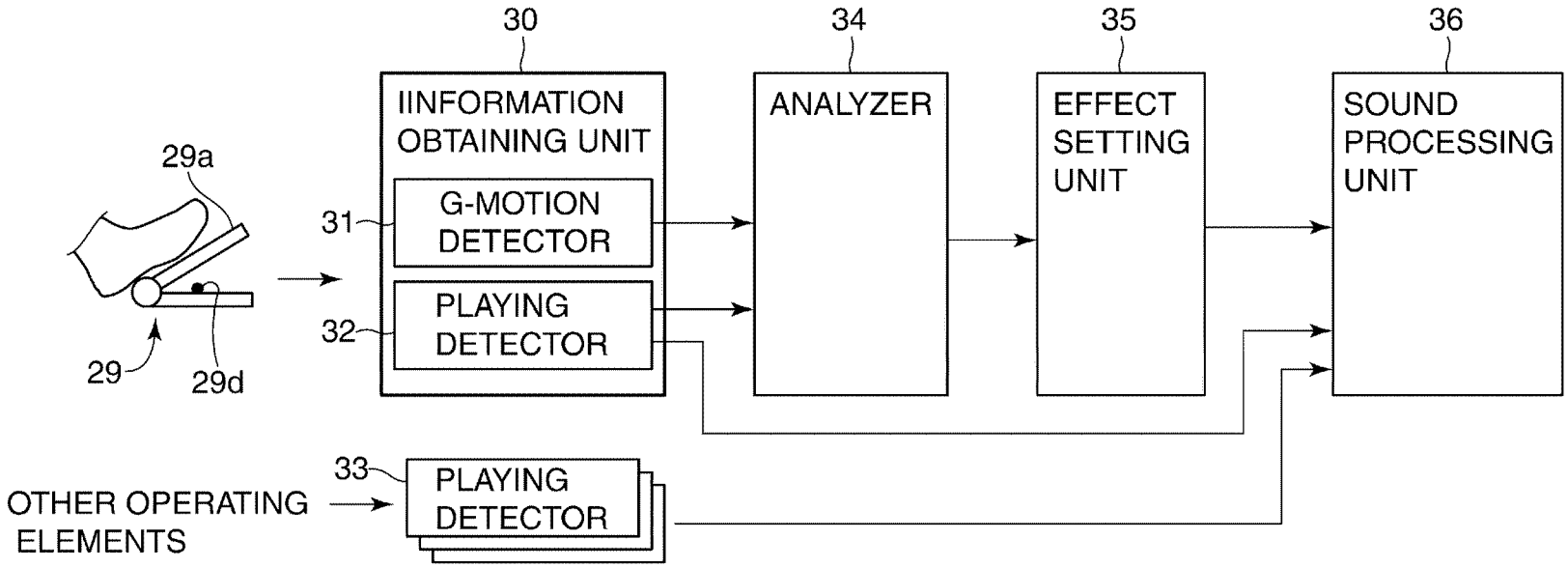
FIG. 4 is a block diagram illustrating a functional mechanism for implementing a sound production control.

FIG. 3C is a diagram illustrating a pulse waveform generated on the basis of the detected waveforms W1 and W2. FIG. 4 is a block diagram illustrating a functional mechanism for implementing the subject sound production control. This functional mechanism has an information obtaining unit 30, a playing detector 33, an analyzer 34, an effect setting unit 35, and a sound processing unit 36. The information obtaining unit 30 has a G-motion detector 31 and a playing detector 32. The functions of the information obtaining unit 30 and the playing detector 33 are implemented mainly thorough the cooperation of the CPU 5 and the detection circuit 3. The functions of the analyzer 34 and the effect setting unit 35 are implemented mainly thorough the cooperation of the CPU 5, the RAM 7, and the timer 8. The function of the sound processing unit 36 is implemented mainly thorough the cooperation of the CPU 5, the sound source circuit 13, the effect circuit 14, and the sound system 15.

As illustrated in FIG. 4, the detection output from the pedal sensor 29*d* is input to the information obtaining unit 30. The information obtaining unit 30 detects a peak of the output waveform from the motion stroke of the hi-hat pedal portion 29*a* (output of the pedal sensor 29*d*) using first and second threshold values th1 and th2 (where th1>th2, refer to FIG. 3A). In particular, the G-motion detector 31 detects a peak timing of the waveform W2, and the playing detector 32 detects a peak timing of the waveform W1. The outputs of the G-motion detector 31 and the playing detector 32 are input into the analyzer 34. The output of the playing detector 32 is used to generate a sound trigger of foot-close operation and is also input into the sound processing unit 36. The detection output from the pedal sensor 25 of the kick unit 28 or the percussion sensor corresponding to each pad 21 except for the hi-hat unit 29 is input into the playing detector 33. The output of the playing detector 33 is input into the sound processing unit 36. That is, the outputs of the playing detectors 32 and 33 are used to generate sound triggers corresponding to respective sound production. Meanwhile, the output of the G-motion detector 31 is not used to generate the sound trigger. The outputs of the playing detector 32 and the G-motion detector 31 are used in the effect setting through the analyzer 34.

As illustrated in FIG. 3C, the analyzer 34 generates tempo pulses (click pulses) corresponding to the peak timings of the detected waveform on the basis of each peak detected by the G-motion detector 31 and the playing detector 32. Specifically, the analyzer 34 generates a pulse (rising edge) of the waveform W1 at the peak timing. This is because the peak timing of the waveform W1 is a beat timing desired by a player. Meanwhile, in the case of the waveform W2, a pulse (rising edge) is generated at the timing after a correction value "t0-tp" from the peak timing. This is because the time point t0 is a beat timing substantially desired by a player. The correction value "t0-tp" is stored in the ROM 6 or the like in advance in a table format or a computational formula format as a set value depending on the playing tempo. The correction value "t0-tp" is set to a smaller value as the playing tempo becomes faster. A proper setting of the correction value "t0-tp" is different on a player-by-player basis. Therefore, preferences of each player may be investigated in advance to provide a table or the like for each player.

The analyzer 34 analyzes the generated pulse to estimate both a beat interval D and a playing tempo TP. Here, basically, positions of the pulses correspond to the beats of the instrumental. A time interval between neighboring pulses matches the beat interval D. However, detection errors or a deviation in the player's motion may occur. It should be noted that a motion may stop during the detection. In this case, the pulse generation also stops. To cope with this, a moving average calculation method is employed in the estimation of the beat interval D. For example, the analyzer 34 calculates the time interval between the neighboring pulses on the basis of a predetermined number of pulses (for example, ten pulses) obtained immediately before the computation of the beat interval D. The analyzer 34 determines an average of the time intervals between pulses excluding its maximum and minimum as the beat interval D. Since the playing tempo TP is defined as the number of beats per minute, the playing tempo is calculated as "TP=6000/beat interval (ms)." It should be noted that the number of pulses used to calculate the beat interval D is not limited to those described above. In addition, the method of calculating the beat interval D on the basis of the pulse interval is not limited to those described above.

The effect setting unit 35 sets a delay effect as an example of the effect. Specifically, the effect setting unit 35 determines a delay setting value DT and sets a delay time DTT (setting value of the counter) on the basis of the delay setting value DT. The delay time DTT may be set to a common value in overall pads, that is, overall sound production channels. However, in this embodiment, it is assumed that a different delay time DTT is set for each sound production channel as expressed as "DTTn=DT×K(n)." Here, "K(n)" denotes a correction coefficient set for each pad (sound production channel) and is determined in advance. The sound processing unit 36 executes a sound production process in accordance with the output signals from the playing detectors 32 and 33 in a real-time reproduction. In this case, the sound processing unit 36 applies the effect based on the effect control parameters set by the effect setting unit 35 to the playing signals generated from the output signals, and amplifies and outputs the playing signals with the effect.

Figure 5:
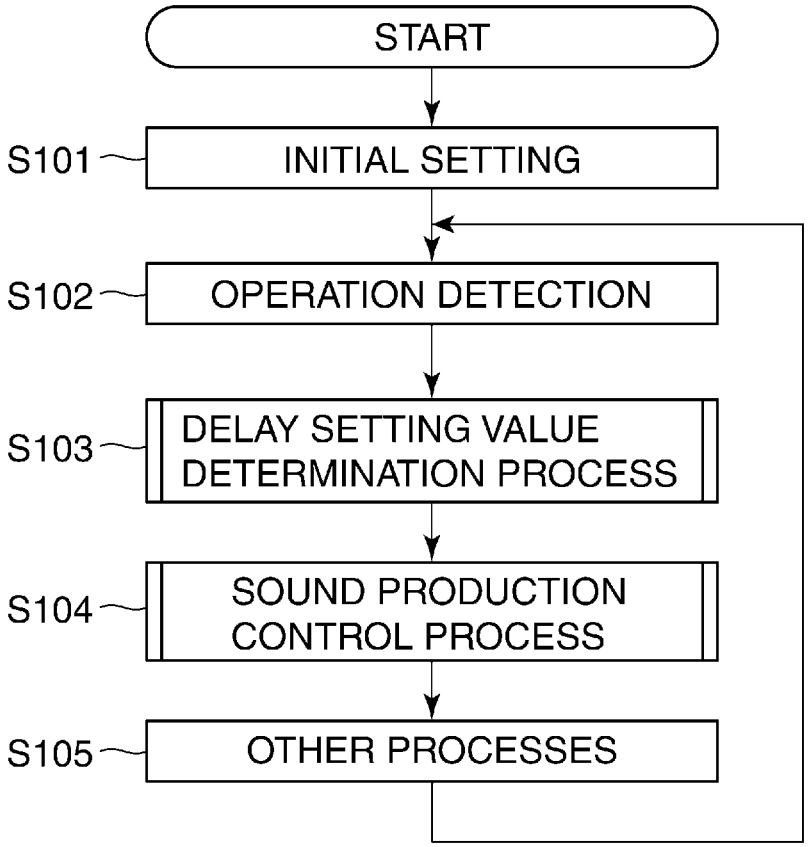
FIG. 5 is a flowchart illustrating a main process.

FIG. 5 is a flowchart illustrating a main process. Each step of this flowchart is implemented when the CPU 5 reads out a program stored in the memory device 10 or the ROM 6 to the RAM 7 and executes it. First, the CPU 5 executes an initial setting, that is, starts execution of the control program to set initial values in various registers, receives device settings from the setting manipulator 2, and sets the received settings (step S101). In step S101, a player may determine whether or not a delay effect is applied to the sound produced from a real-time play (delay ON/OFF).

Then, the CPU 5 detects a percussion on the pad 26 of the kick unit 28, a foot-close sound production operation using the hi-hat unit 29, and other percussions on each of other pads 21 through the functions of the playing detectors 32 and 33 (step S102). Specifically, it is detected "THERE IS PERCUSSION" when the output from each sensor of the pad 21 exceeds a predetermined value (threshold value) set for each sensor. It should be noted that a sound production instruction for the foot-close operation of the hi-hat unit 29 is detected as "THERE IS PERCUSSION" when the output of the pedal sensor 29*d* exceeds the first threshold value th1. Then, the CPU 5 sequentially executes a delay setting value determination process (step S103) and an effect control process (step S104) described below in conjunction with FIGS. 6 and 7. In addition, the CPU 5 executes other processes (step S105). In the other processes, for example, when an automatic reproduction process is executed, the CPU 5 performs the control such that playing data is read, the preset effect process is applied to the generated playing signal, and the playing signal is amplified and output. Then, the process returns to step S102.

Figure 6:
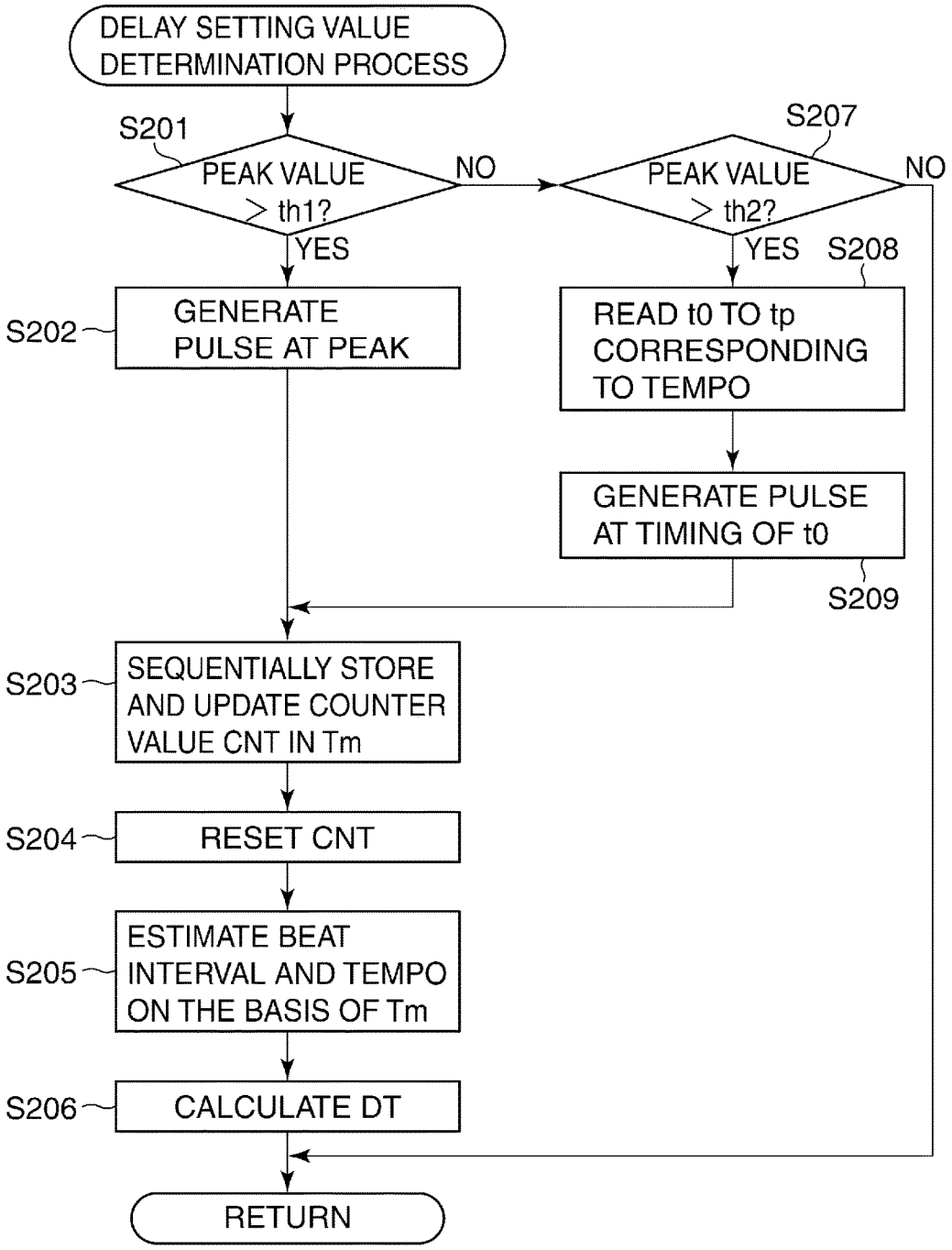
FIG. 6 is a flowchart illustrating a delay setting value determination process.

FIG. 6 is a flowchart illustrating the delay setting value determination process executed in step S103 of FIG. 5. First, the CPU 5 detects a peak from the detection output of the pedal sensor 29*d* using the first threshold value th1 as a function of the information obtaining unit 30. That is, the playing detector 32 of the information obtaining unit 30 determines whether or not the peak value of the detected waveform exceeds the first threshold value th1 (peak>th1) (step S201). As a result of the determination, if the peak value exceeds the first threshold value th1, it is determined that the operation for foot-close playing is detected. Since the peak of the waveform W1 (first detection information) is obtained (refer to FIG. 3A), the process advances to step S202.

Otherwise, if the peak value does not exceeds the first threshold value th1 (peak value th1), the information obtaining unit 30 detects a peak from the detection output of the pedal sensor 29*d* using the second threshold value th2 (step S207). That is, the G-motion detector 31 of the information obtaining unit 30 determines whether or not the peak value of the detected waveform exceeds the second threshold value th2 (peak value>th2). As a result of the determination, if the peak value exceeds the second threshold value th2 (th1>peak value>th2), it is determined that the operation of G-motion is detected, and the peak of the waveform W2 (second detection information) is obtained (refer to FIGS. 3A and 3B). Then, the process advances to step S208. If the peak value does not exceed the second threshold value th2 (peak value≤th2), no motion is detected, and the detection information is not obtained (that is, this is similar to a state that no operation is made). Therefore, the process of FIG. 6 is terminated.

If it is determined that operation for foot-close playing is detected in step S201, the CPU 5 generates a tempo pulse having an edge rising at the peak timing (peak timing of the waveform W1) when the output exceeds the first threshold value th1 as a function of the analyzer 34, and the process advances to step S203 (step S202). Meanwhile, if it is determined that operation of the G-motion is detected in step S207, the CPU 5 reads the correction value "t0-tp" corresponding to the current playing tempo TP (estimated in the previous step S205, excluding the first step S205) from the ROM 6 as a function of the analyzer 34 (step S208). Then, the CPU 5 generates a tempo pulse having a rising edge delayed by the read correction value "t0-tp" from the peak timing (peak timing of the waveform W2) at which the output becomes "th1>peak value>th2" as a function of the analyzer 34 (step S209). Then, the process advances to step S203. The pulse of FIG. 3C is obtained by combining the pulses generated in steps S202 and S209 in a time-series manner.

Subsequently, as a function of the analyzer 34, the CPU 5 deletes the oldest value in the register Tm (where "m" denotes a natural number, for example, 0 to 9) and stores the current value of the counter CNT as the latest value in the register Tm (step S203). Therefore, the value in the register Tm is updated in a first-in-first-out manner, and the latest ten values are stored in the register Tm at all times. Then, the CPU 5 resets the counter CNT as a function of the analyzer 34 (step S204). Therefore, the time elapsing from the previous pulse generation to the current pulse generation (that is, a pulse time interval) is recorded in the register Tm. The CPU 5 estimates the beat interval D on the basis of the value of the register Tm and estimates the playing tempo TP on the basis of the beat interval D as a function of the analyzer 34 (step S205). That is, as described above, the CPU 5 calculates an average of the values in the register Tm excluding the minimum and the maximum values as the beat interval D as a function of the analyzer 34. In addition, the analyzer 34 calculates the playing tempo TP on the basis of the beat interval as a function of the analyzer 34.

Then, in step S206, the CPU 5 calculates the delay setting value DT on the basis of the beat interval D as a function of the effect setting unit 35. Here, a table or a calculation formula that defines a relationship between the beat interval D and the delay setting value DT is stored in the ROM 6 or the like in advance, and the delay setting value DT is determined by referencing the table or the calculation formula. Then, the process of FIG. 6 is terminated.

Figure 7:
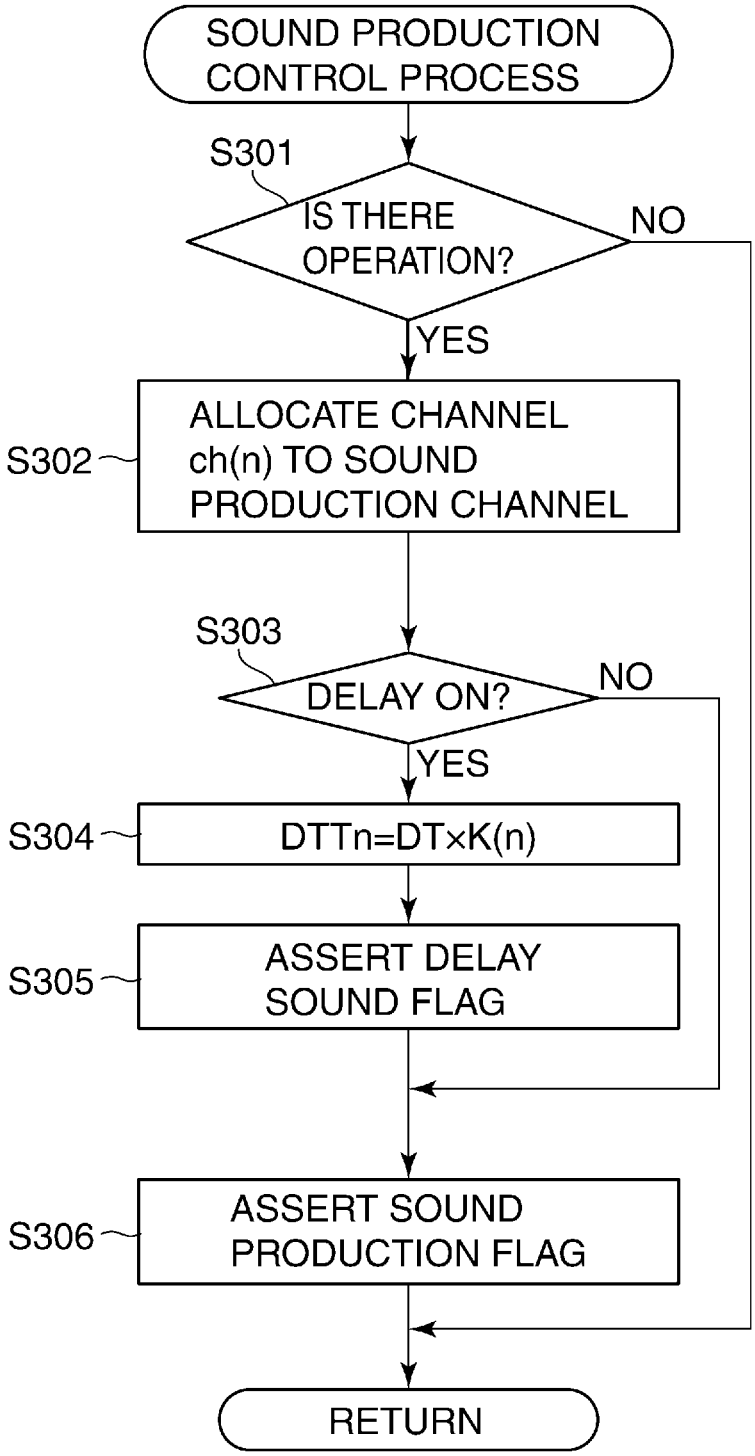
FIG. 7 is a flowchart illustrating an effect control process.

FIG. 7 is a flowchart illustrating the effect control process executed in step S104 of FIG. 5. This process is executed for each pad, that is, for each sound production channel. First, the CPU 5 determines whether or not there is a percussion or operation on a processing target such as the pads 26, the kick unit 28, or the hi-hat unit 29 in step S102 described above (step S301). This operation includes the foot-close playing operation of the hi-hat pedal portion 29*a*. Then, when there is operation on the detection target such as the pads 21, the kick unit 28, or the hi-hat unit 29, the CPU 5 allocates a channel counter value ch(n) to the sound production channel ch serving as a processing target of this sound production control (step S302). Here, "n" denotes a channel number. It should be noted that the number of the used channels is set as a channel number parameter "max" (for example, sixteen).

Then, the CPU 5 determines whether or not the sound production of the processing target such as the pad 21, the kick unit 28, and the hi-hat unit 29 is set to be applied with a delay effect (delay ON) (step S303). As a result of the determination, if the sound production is set not to be applied with the delay effect, the CPU 5 advances the process to step S306. Otherwise, if the sound production is set to be applied with the delay effect, the CPU 5 sets the delay time DTTn as "DTTn=DT×K (n)" as described above as a function of the effect setting unit 35 (step S304). Then, the CPU 5 asserts a delay sound flag (step S305) and a sound production flag (step S306), and the process of FIG. 7 is terminated. If the sound production flag and the delay sound flag are asserted, the sound is produced and the delay effect is applied.

Figure 8:
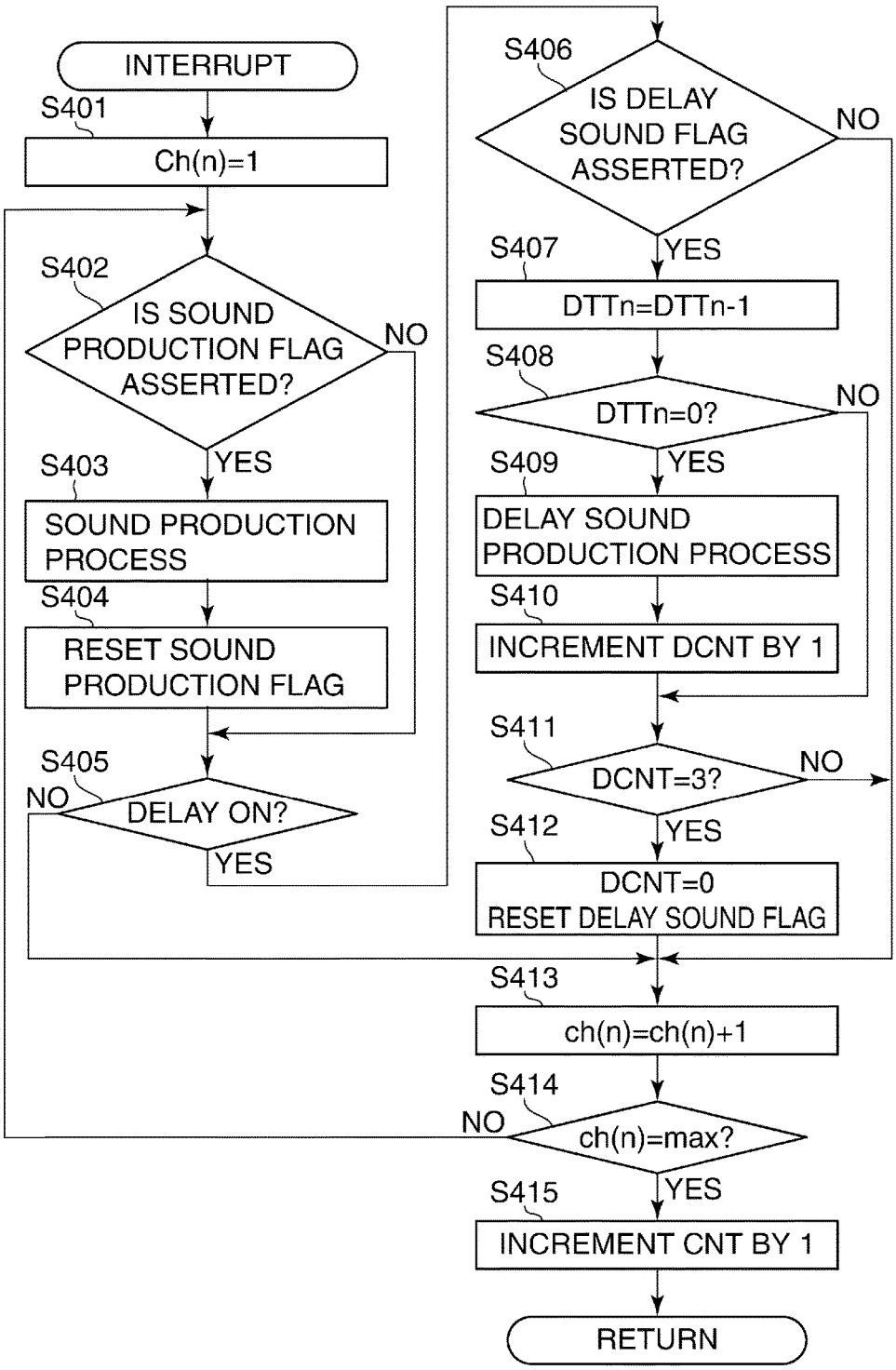
FIG. 8 is a flowchart illustrating an interrupt process.

FIG. 8 is a flowchart illustrating the interrupt process. This process is implemented when the CPU 5 reads out a program stored in the memory device 10 or the ROM 6 to the RAM 7 and executes it. This process is executed at every predetermined time interval (for example, every 1 ms) after the power is turn-on.

First, the CPU 5 sets the channel counter ch(n) to "1" (step S401) and determines whether or not the sound production flag is asserted (step S402). As a result of the determination, if the sound production flag is not asserted, the CPU 5 advances the process to step S405 because it is not necessary to perform the sound production. Otherwise, if the sound production flag is asserted, the CPU 5 executes the sound production process by generating a sound trigger in the sound production channel ch serving as the current processing target in the sound source circuit 13 (step S403) and resets the sound production flag (step S404). Then, the process advances to step S405.

In step S405, the CPU 5 determines whether or not a delay effect is to be applied (delay ON). If the delay effect is not to be applied, it is not necessary to apply the delay effect. Therefore, the process advances to step S413. Otherwise, if the delay effect is to be applied, the CPU 5 determines whether or not the delay sound flag is asserted (step S406). As a result of the determination, if the delay sound flag is not asserted, it is not necessary to apply the delay effect. Therefore, the CPU 5 advances the process to step S413. Otherwise, if the delay sound flag is asserted, the delay time DTTn is decremented by "1" for updating the delay time DTTn (step S407).

Then, in step S408, the CPU 5 determines whether or not the delay time DTTn becomes zero (DTTn=0). As a result of the determination, if the delay time DTTn does not become zero, the CPU 5 advances the process to step S411 because it is not the timing at which the delay is to be applied. Otherwise, if the delay time DTTn becomes zero, the CPU 5 produces the delay sound (step S409) and increments a repetition counter DCNT by "1" for updating the repetition counter DCNT (step S410). Then, in step S411, the CPU 5 determines whether or not the updated repetition counter DCNT reaches a delay repetition number (for example, three times (DCNT=3)). If the condition of DCNT=3 is not satisfied, the process advances to step S413. Meanwhile, if the condition of DCNT=3 is satisfied, the CPU 5 resets both the repetition counter DCNT and the delay sound flag (step S412), and the process advances to step S413. Therefore, during the delay time DTT elapses after sound is produced in response to the percussion, the delay sound is repeatedly generated as many as the delay repetition number. It should be noted that the delay sound production number may be set to one or more.

Subsequently, the CPU 5 updates the channel counter ch(n) by incrementing it by "1" (step S413) and determines whether or not the channel counter ch(n) reaches the channel number parameter "max" (ch(n)=max) (step S414). As a result of the determination, if the condition "ch (n)=max" is not satisfied, the CPU 5 returns the process to step S402. If the condition "ch (n)=max" is satisfied, the counter CNT is updated by incrementing it by "1" (step S415). Then, the process of FIG. 8 is terminated.

According to this embodiment, the sound production control is performed on the basis of information (peak timing of the waveform W2) obtained by the information obtaining unit 30 (or the G-motion detector 31 included therein) at least from operation that does not generate the sound trigger out of the detection information obtained by detecting a player's motion. Therefore, even in the non-playing control operation period, a sound production mode can be controlled by the player's motion. In particular, since the sound production mode control is a control for applying the sound effect such as a delay sound, it is possible to reflect the non-playing player's motion on the sound production. In addition, since the detection information is obtained on the basis of the operation of the hi-hat pedal portion 29*a* as a operating element, it is possible to reflect an operation that is not intended to play the operating element on the sound production control. In particular, since the G-motion has been influenced from accents, presence, tempo, or "groove" of the music, it is possible to obtain the more excellent sound quality by using the G-motion in the sound production control.

Since the effect based on the G-motion on the hi-hat pedal portion 29*a* is also given to the sound produced by operating the hi-hat pedal portion 29*a*, the sound production based on a playing motion on the operating element can be controlled on the basis of a player's motion on the operating element without intention of playing the operating element. In addition, the beat interval D is estimated from the information that is not used in the sound trigger, and the sound production is controlled on the basis of the estimated beat interval D. Therefore, a motion for keeping the beat without intention of play can be reflected on the sound production control. Furthermore, since the playing tempo TP is calculated on the basis of the estimated beat interval D, it is possible to estimate the playing tempo TP from a player's motion without intention of play. Therefore, even during a non-playing control operation period, it is possible to estimate the playing tempo TP from a player's motion and reflect it on the sound production control.

It should be noted that, according to this embodiment, the G-motion is detected from a movement of the hi-hat pedal portion 29*a* as a operating element. However, the present invention is not limited thereto. Information that generates no sound trigger out of the detection information detected from the player's motion may be detected as the G-motion. Therefore, an operating element used in detection of the G-motion may be different from an operating element for generating a sound trigger as a control target. For example, as illustrated in FIG. 9, an operating element or device which can be operated by a player may be provided as a device dedicated to G-motion detection.

Figure 9:
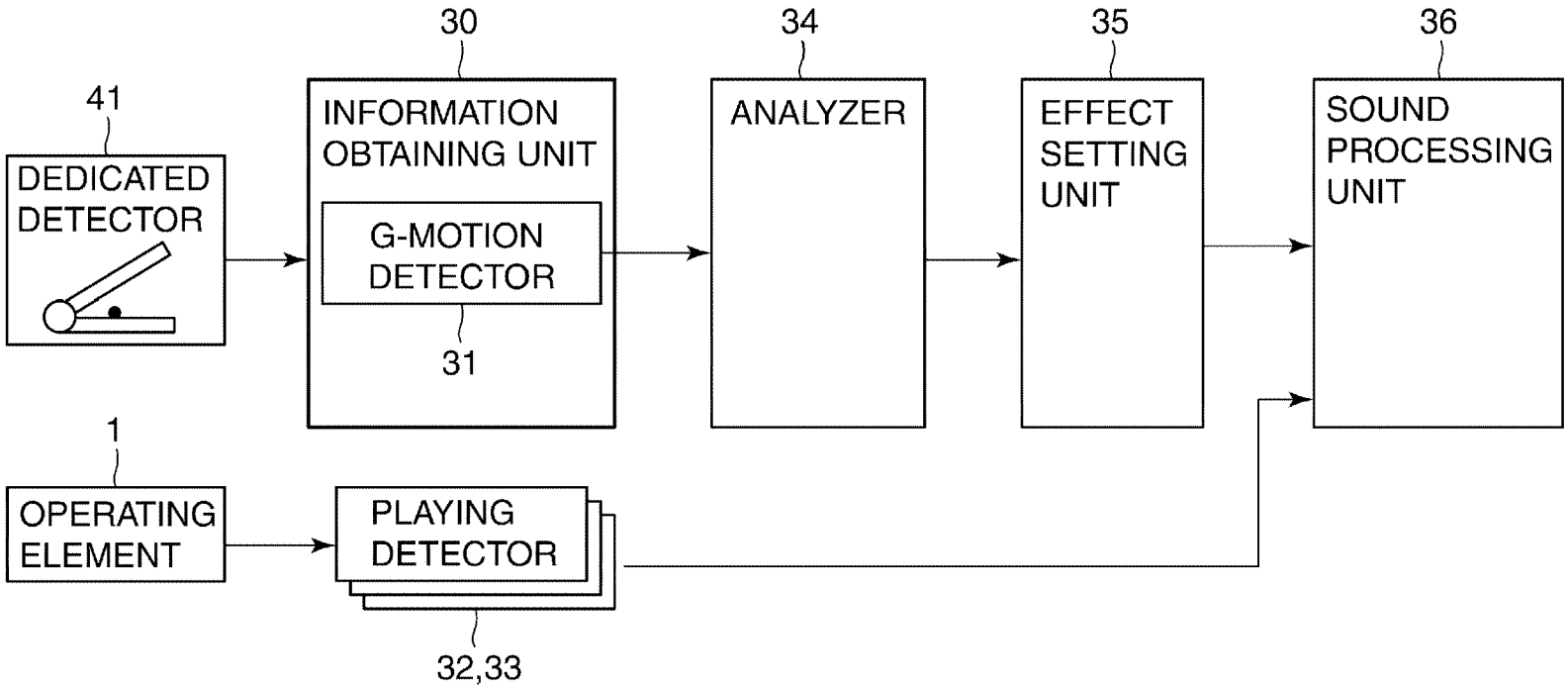
FIG. 9 is a block diagram illustrating a functional mechanism for implementing a sound production control according to a modification.

FIG. 9 is a block diagram illustrating a functional mechanism for implementing a sound production control according to a modification. Comparing the configuration of FIG. 4, a dedicated detector 41 is newly provided instead of the G-motion structure using the hi-hat pedal portion 29*a*, and the G-motion is detected from operation thereof. The hi-hat pedal portion 29*a* is included in the operating element 1. The information obtaining unit 30 does not have the playing detector 32. The dedicated detector 41 is comprised of, for example, an ON/OFF type foot controller and can detect a binary value, that is, ON and OFF. The dedicated detector 41 is installed in a place where a player can operate it with his/her foot during a non-playing control operation period. It should be noted that the dedicated detector 41 may be operated by a percussion of a drumstick as in a dummy pad that does not relate to the play sound production. The information obtaining unit 30 generates a pulse at the ON timing of the dedicated detector 41. The processes of the analyzer 34, the effect setting unit 35, and the sound processing unit 36 after the pulse generation are similar to those described above.

It should be noted that the device for detecting the G-motion may be installed in a position, for example, where the G-motion of a player's body is reflected. In addition, the G-motion is not necessarily detected from operation for the operating element. For example, the G-motion may be detected through taking a motion image of a certain part of a player's body by a camera, analyzing the taken image, and additionally reflecting the amount and the direction of the motion.

Although the effect is set on the basis of the motion of the hi-hat pedal portion 29*a* according to the present invention, the effect may be set by detecting a G-motion on the basis of the motion of the kick pedal 24. In addition, in the case of a pad 21 that is directly stricken, such as a snare drum, a motion may be distinguished into a percussion or a G-motion on the basis of a magnitude of the vibration. In this case, a small percussion having a signal level that is equal to or lower than a predetermined value and does not cause a sound trigger may be regarded as the G-motion.

It should be noted that the present invention may also be applied to instruments other than the percussive instrument. For example, in the case of a keyboard instrument, a G-motion may be detected on the basis of a pedal movement, and control parameters such as the beat interval D, the delay time DTTn, and the playing tempo TP may be determined on the basis of the pedal movement. The present invention may also be applied to a sound production control in music games or the like without limiting to the instrument. In addition, as the sound production control mode implemented in the present invention, a volume or a tone may be controlled without limiting to the delay effect. Therefore, the present invention can also be applied to determination of control parameters such as a rate of a flanger or phaser effect, a setting of a low frequency oscillator (LFO) in a wah effect, a period change time in a tremolo or a rotary speaker, a distortion rate of a distortion effect, and a cut-off frequency of a filter. It should be noted that the effect level (degree of effect) may be further controlled on the basis of the peak value H of the waveform W2 in FIG. 3B.

Although the control parameters are estimated or determined on the basis of a detection result of a player's G-motion during a non-playing control operation period to reflect them on the sound production control in the embodiment of the present invention, even if at least the control parameters are estimated or determined on the basis of a detection result of a player's G-motion during a non-playing control operation period, the present invention is fully implemented. Therefore, the embodiment of the present invention may include a case in which the control parameters are additionally estimated or determined from a player's motion during a playing control operation period in which playing operation or controlling operation is performed, the control parameters estimated or determined on the basis of not only a detection result of a player's G-motion operation during a non-playing control operation period but also a player's motion during a playing control operation period, and the control parameters are reflected on the sound production control.

Figure 10A:
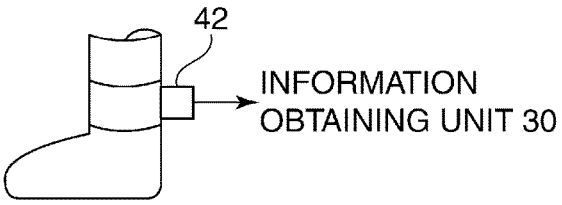
FIGS. 10A to 10C are schematic diagrams illustrating a detection mechanism according to a modification.
Figure 10B:
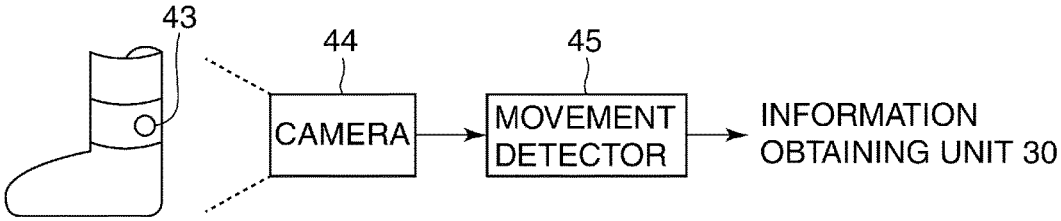
Figure 10C:
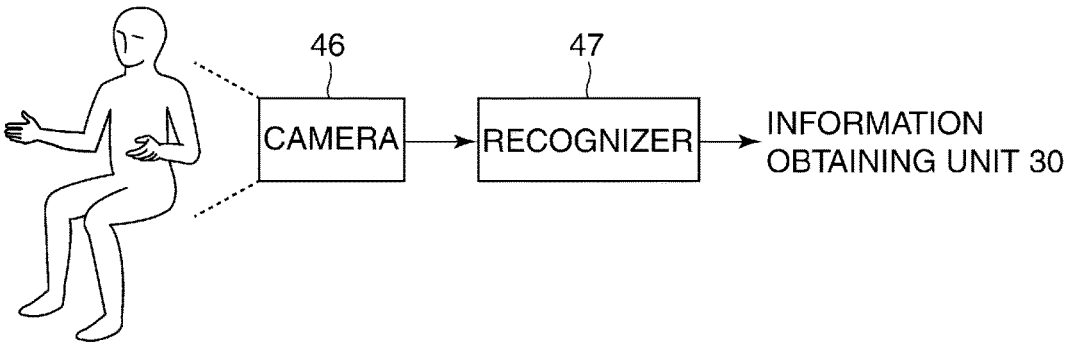

As a specific configuration of the detection mechanism for detecting operation that generates a sound trigger or operation that generates no sound trigger, the modification illustrated in FIGS. 10A to 10C may be conceived. The subject detection mechanism corresponds to the pedal sensor 29*d* (FIG. 4) or the dedicated detector 41 (FIG. 9). In the example of FIG. 10A, an accelerometer 42 as a sensor for detecting a movement of a player's body portion is attached to a player's body. In order to detect a G-motion, the accelerometer 42 is attached, for example, to a left ankle. The detection signal of the accelerometer 42 is input to the information obtaining unit 30. The detection signal of the accelerometer 42 for detecting a G-motion is used in effect setting executed by the effect setting unit 35. For example, the CPU 5 determines that there is a G-motion when the left ankle is displaced or reciprocated by a predetermined length. Then, the CPU 5 changes the sound production mode. It should be noted that a plurality of accelerometers 42 may be attached. Alternatively, in addition to the accelerometer 42 for detecting a G-motion, an accelerometer for generating a sound trigger may be attached to a player's body (such as the left hand, the right hand, or the right ankle). The detection signal of the accelerometer for generating a sound trigger is used in real-time reproduction executed by the sound processing unit 36.

In the example of FIG. 10B, a marker 43 such as a reflective material is attached to a player's body, and an image of the marker 43 is taken by a camera 44. A movement detector 45 analyzes the image taken by the camera 44 to detect a movement of the marker 43. The output of the movement detector 45 is input to the information obtaining unit 30. The marker 43 is attached, for example, to both ankles. The CPU 5 performs calibration at the start of the detection to specify initial positions of each marker 43. Then, the CPU 5 changes the sound production mode in accordance with the movements of both markers 43 while tracing the positions of both markers 43. The taking an image may be performed using infrared light. It should be noted that the sound production may be performed in accordance with the movement of the marker 43 attached to the right ankle as well as the sound production mode may be changed in accordance with the movement of the marker 43 attached to the left ankle. In addition, any number of markers 43 may be attached. Furthermore, the movement detection result may also be used as described above in the example of FIG. 10A.

In the example of FIG. 10C, an image of a player's whole-body is taken by a camera 46, and a recognizer 47 analyzes the taken image to obtain mainly movements of the arms and the legs. In order to detect the movement of a body portion such as the arms and the legs, a technique of detecting human body parts by tracking skeletal kinematics (well known in the art) may be employed. If this technique is employed, it is not necessary to use any marker. For example, as discussed in the website URL: http://news.mynavi.jp/series/computer_vision/069/, a body part recognition technique (random decision forests algorithm) may be employed. In the example of FIG. 10C, a human body part for generating a sound trigger and a human body part for the effect setting may be different from each other in the human body to be detected. For example, a detection result of a body part (such as the left hand, the right hand, or the right ankle) is used to generate a sound trigger, and a detection result of the other part (such as the left ankle) may be used to detect a G-motion. Any number of body parts may be used as the detection target, and the movement detection result may also be used as described above in the example of FIG. 10A.

It should be noted that similar effects may be achieved by causing the apparatus of the present invention or a computer to read a storage medium capable of storing a control program as software according to the present invention. In this case, the program codes themselves read from the storage medium implement the novel functions according to the present invention, and the storage medium in which the program codes are stored implements the present invention. The program codes may also be supplied via a transmission medium or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-048197 filed on Mar. 11, 2016 and the benefit of Japanese Patent Application No. 2017-005823 filed on Jan. 17, 2017, which are hereby incorporated by reference herein in their entireties.

What is claimed is:

1. A sound production control apparatus comprising:

an information obtaining unit that obtains detection information by detecting a player's motion sensed by a sensor;

a sound production unit that produces sound on the basis of the obtained detection information in response to an operation for generating a sound trigger according to the player's motion sensed by the sensor; and a control unit that controls application of a sound effect by the sound production unit on the basis of the obtained detection information in response to an operation in which no sound trigger is generated according to the player's motion sensed by the sensor.

2. The sound production control apparatus according to claim 1, wherein the information obtaining unit obtains the detection information from a displacement of an operating element.

3. The sound production control apparatus according to claim 2, wherein the information obtaining unit obtains the detection information from a motion stroke of the operating element using a first threshold value and a second threshold value lower than the first threshold value, and the control unit uses first detection information obtained by the information obtaining unit on the basis of the first threshold value to generate the sound trigger and uses second detection information obtained by the information obtaining unit on the basis of the second threshold value to control the application of the sound effect by the sound production unit.

4. The sound production control apparatus according to claim 1, wherein the information obtaining unit obtains the detection information on the basis of a movement of the player's body.

5. The sound production control apparatus according to claim 1, wherein the control unit estimates a beat interval on the basis of the obtained detection information in response to the operation in which no sound trigger is generated according to the player's motion sensed by the sensor and controls the application of the sound effect by the sound production unit on the basis of the estimated beat interval.

6. The sound production control apparatus according to claim 1, wherein the control unit estimates a playing tempo performed by the player on the basis of the obtained detection information in response to the operation in which no sound trigger is generated according to the player's motion sensed by the sensor.

7. The sound production control apparatus according to claim 1, wherein the information obtaining unit obtains the detection information by detecting a player's pushing motion of a pedal, and based on the detected player's pushing motion of the pedal, either the sound production unit produces the sound or the control unit controls application of the sound effect by the sound production unit according to an amount of depression of the pedal caused by the player's pushing motion of the pedal.

8. The sound production control apparatus according to claim 1, wherein the information obtaining unit obtains the detection information by detecting a player's motion, and based on the detected player's motion, either the sound production unit produces the sound or the control unit controls application of the sound effect by the sound production unit according to an extent of the player's motion.

9. A sound production control apparatus comprising:

an information obtaining unit that obtains detection information by detecting a player's motion sensed by a sensor;

a sound production unit that produces sound on the basis of the obtained detection information in response to an operation a sound trigger according to the player's motion sensed by the sensor; and an estimation unit that estimates a playing tempo performed by the player on the basis of the obtained detection information in response to an operation in which no sound trigger is generated according to the player's motion sensed by the sensor.

10. A sound production control method comprising:

obtaining detection information by detecting a player's motion sensed by a sensor;

producing sound on the basis of the obtained detection information in response to an operation a sound trigger according to the player's motion sensed by the sensor; and controlling application of a sound effect to produced sound on the basis of the obtained detection information in response to an operation in which no sound trigger is generated according to the player's motion sensed by the sensor.

11. A sound production control method comprising:

obtaining detection information by detecting a player's motion sensed by a sensor;

producing sound on the basis of the obtained detection information in response to an operation a sound trigger according to the player's motion sensed by the sensor; and estimating a playing tempo performed by the player on the basis of the obtained detection information in response to an operation in which no sound trigger is generated according to the player's motion sensed by the sensor.

12. A non-transitory computer readable storage medium that stores a program for causing a computer to execute a sound production control method, the sound production control method comprising:

obtaining detection information by detecting a player's motion sensed by a sensor;

producing sound on the basis of the obtained detection information in response to an operation a sound trigger according to the player's motion sensed by the sensor; and controlling application of a sound effect to produced sound on the basis of the obtained detection information in response to an operation in which no sound trigger is generated according to the player's motion sensed by the sensor.

13. A non-transitory computer readable storage medium that stores a program for causing a computer to execute a sound production control method, the sound production control method comprising:

obtaining detection information by detecting a player's motion sensed by a sensor;

producing sound on the basis of the obtained detection information in response to an operation a sound trigger according to the player's motion sensed by the sensor; and estimating a playing tempo performed by the player on the basis of the obtained detection information in response to an operation in which no sound trigger is generated according to the player's motion sensed by the sensor.

* * * * *